US008922379B1

(12) United States Patent
Meyer

(10) Patent No.: US 8,922,379 B1
(45) Date of Patent: Dec. 30, 2014

(54) CENTRALIZED WATER LEAK DETECTION SYSTEM

(76) Inventor: John Meyer, Pompano Beach, FL (US)

( * ) Notice: Subject to any disclaimer, the term of this patent is extended or adjusted under 35 U.S.C. 154(b) by 54 days.

(21) Appl. No.: 13/542,226

(22) Filed: Jul. 5, 2012

Related U.S. Application Data

(60) Provisional application No. 61/504,614, filed on Jul. 5, 2011.

(51) Int. Cl.
*G08B 21/00* (2006.01)

(52) U.S. Cl.
USPC ..... 340/605; 340/521

(58) Field of Classification Search
USPC ..... 340/605, 521
IPC ..... G08B 1/00,25/00, 7/00
See application file for complete search history.

(56) References Cited

U.S. PATENT DOCUMENTS

2010/0114386 A1* 5/2010 Fima ..... 700/276
2010/0188206 A1* 7/2010 Kates ..... 340/521

* cited by examiner

*Primary Examiner* — Shirley Lu
(74) *Attorney, Agent, or Firm* — H. John Rizvi; Gold & Rizvi P.A.

(57) ABSTRACT

The present invention provides a centralized water leak detection system for detecting water leaks in residential and commercial buildings. The water leak detections system provides central station monitoring and point identification data of water leaks. The centralized water detection system includes a plurality of address modules connected to a plurality of sensors for assigning an identifier to each sensor. The address modules are connected to a central control for processing detected sensor signals. A water alarm annunciator is remotely installed in a central monitoring station for displaying point identification data showing detection and location of water leaks.

7 Claims, 3 Drawing Sheets

CENTRALIZED WATER LEAK DETECTION SYSTEM

CROSS-REFERENCE TO RELATED APPLICATION

This Non-Provisional Utility application claims the benefit of U.S. Provisional Patent Application Ser. No. 61/504,614, filed on Jul. 5, 2011, which is incorporated herein in its entirety.

FIELD OF THE INVENTION

The present invention relates generally to detection systems, and more particularly, to a centralized water leak detection system for monitoring water leaks throughout residential or commercial buildings, and for providing visual and audible warnings of water leaks.

BACKGROUND OF THE INVENTION

Undetected water leaks in residential and commercial buildings can lead to extensive water damage to building structure. The cost of repairing the damage can extend well into the thousands of dollars if the water leaks are not detected in a timely manner. Because water leaks often occur out of sight and in discrete places like in walls, attics, behind cabinets, under floors, under appliances, or basements, accumulated water is often the only indication that a water leak is present. Undetected water leaks can also pose a health risk to occupants. Unresolved water leaks lead to the growth of hazardous mold, mildew, and fungus that can spread quickly to surrounding areas. Water leaks typically occur from a diversity of water sources including home appliances such as washing machines, dishwashers, water coolers, and dehumidifiers. Other sources of water leaks include leaking water pipes, faucets, hot water heaters, in-line water filters, and valves. Accumulated moisture or condensation generated from air conditioners or ventilation units can also be indicative of water leaks and thus, detecting moisture and condensation is also beneficial in water leak detection applications. Water leaks are often the result of aging appliances, deteriorating solder joints, improper piping or equipment installations, corrosion, or high-pressure water sources that impact joints and connections.

Property owners and businesses generally insure themselves against the possible damage due to water leaks; however, the sky rocketing costs of insurance premiums pose more of a challenge to owners having larger, residential or commercial buildings. Water leaks are particularly undesirable in residential dwellings and commercial buildings involving a large number of residential units, apartments, or offices. An undetected water leak in one apartment or office can quickly spread causing considerable damage to adjacent areas. Particularly in large residential buildings, often a number of residents are away on business, vacationing, or visiting family and friends, thereby leaving their apartment or condo unoccupied for days. Also, workers occupying commercial buildings typically retire for the day leaving their offices unoccupied at night. Any undetected water leaks can quickly flow through the walls, floors or ceilings of unoccupied areas and seep into adjacent areas, further damaging neighboring building structure, and expensive office equipment.

Central heating, ventilation, and air conditioning systems include chillers. The chillers are generally located at an elevated location within or atop of a structure. Larger chillers are commonly cooled by flowing fluid or water therethrough.

The fluid/water is fed into and from the chiller using high-pressure piping. One potential concern would be a water leak within the piping structure.

The clean-up costs associated with water leaks are often proportional to the amount of water that has accumulated over time. It typically costs more to remove a larger amount of water because the mass of water must be pumped out and completely removed from the localized area before any drying; repairing or reconstruction can be initiated. Response time is vital in implementing remedial measures to correct water leaks. A quick response in addressing water leaks helps mitigate and further prevent costly water damage to equipment, furniture, and to the structural building.

A number of water leak detection devices have been implemented to address the quick response time needed to detect water leaks. Some prior art devices include localized leak detection devices that are situated throughout various locations within a building to alert the presence of water. Such devices typically include a small housing enclosing both a water sensor and audible alarm. One drawback of such devices is that an individual observer must be in arms-length from the detecting device to hear the audible alarm, thus making it impractical for remotely monitoring water leaks. Other devices or systems include well-known closed-circuit type detectors including a receptacle for housing solid-state circuitry that is coupled to one or more sensors where the sensors include two probes or connectors. When water flows onto the probes or conductors, a closed electrical path is provided to produce an alert signal. Such devices make it extremely difficult to detect small amounts of water or moisture, and generally provide no point data indication, including the locations where the sensors are situated throughout the building.

More sophisticated water leak detection systems have been designed to meet the ongoing needs of efficiently monitoring and detecting water leaks. Such automated water detection systems generally include a controller having a number of status indicators, and a plurality of water detection sensors electrically connected to the controller. The status indicators generally include a plurality of light emitting diodes or LED segment blocks that provide a visual indication of the operative location of water sensors. These automated systems suffer a number of drawbacks. One drawback is the number of light emitting diodes needed to represent a larger number of sensors used for in a plurality of locations. For example, an apartment complex having multiple apartments would require a controller to include a numerous amount of status indicators to be able to monitor and detect appliances, pipes, and other water generating devices in each apartment, thus making it impractical, and expensive to construct and implement. Other automated systems incorporate additional monitoring features such as detecting smoke, radon, or carbon monoxide. These systems are expensive, complex, and require a great deal of time to integrate. Thus, conventional automated water leak detection systems are difficult to install, provide limited remote observation of conditions, and are limited in application. The known conventional automated water leak detection systems are not integrated or in continuous communication with into a remote supervised or monitored agency.

Accordingly, there remains in the art a need for a water leak detection system that is easy to install and integrate, provides exact point identification of water leak detection sensors, and is user friendly to operate. There is a further need in the art for a water leak detection system having centralized water detection control in remote communication with a central monitoring agency to provide continuous monitoring, immediate notification, and point identification data of water leaks.

SUMMARY OF THE INVENTION

The present invention provides a water leak detection system that offers centralized water detection, remote station monitoring, and point identification of water leaks. The water detection system includes a plurality of water or moisture sensors that are situated in a variety of different locations throughout residential or commercial buildings for detecting water leaks. A plurality of address modules is electrically interfaced between the sensors and a central control unit for assigning an identifier to each sensor. A central monitoring station includes a remotely installed annunciator for providing visual and audible indications of water leaks.

In accordance with a preferred aspect of the present invention, there is provided a water leak detection system comprising a central control, a plurality of address modules electrically coupled to the central control, a plurality of sensors, each sensor being electrically connected to an address module for assigning an identifier to each sensor, and an annunciator electrically coupled to the central control where the annunciator is remotely installed and displays point identification data of each sensor.

Preferably, the plurality of sensors includes any one of water sensor, moisture sensor, humidity sensor, temperature sensor, gas sensor, pressure sensor, or smoke sensor, and the point identification data of each sensor includes location of sensor and monitored status condition of each sensor.

In another aspect of the present invention, the water sensors are preferably located in key locations. Several exemplary key locations include adjacent to water storage tanks, primary water conduits, lower lying regions respective to the floor level such as edges or corners with the structure, elevator pits, stairwell, and the like. Additionally, the water or fluid sensors can be located near fuel storage containers and/or fuel transfer conduits (i.e. piping).

In another aspect of the present invention, the water sensors can include a pressure monitoring device to monitor and identify a change in pressure of a fluid stored within a container, piping, and the like.

BRIEF DESCRIPTION OF THE DRAWINGS

The invention will now be described, by way of example, with reference to the accompanying drawings, in which.

Like reference numerals refer to like parts throughout the various views of the drawings.

DETAILED DESCRIPTION

The following detailed description is merely exemplary in nature and is not intended to limit the described embodiments or the application and uses of the described embodiments. As used herein, the word "exemplary" or "illustrative" means "serving as an example, instance, or illustration." Any implementation described herein as "exemplary" or "illustrative" is not necessarily to be construed as preferred or advantageous over other implementations. All of the implementations described below are exemplary implementations provided to enable persons skilled in the art to make or use the embodiments of the disclosure and are not intended to limit the scope of the disclosure, which is defined by the claims. For purposes of description herein, the terms "upper", "lower", "left", "rear", "right", "front", "vertical", "horizontal", and derivatives thereof shall relate to the invention as oriented in FIG. 1. Furthermore, there is no intention to be bound by any expressed or implied theory presented in the preceding technical field, background, brief summary or the following detailed description. It is also to be understood that the specific devices and processes illustrated in the attached drawings, and described in the following specification, are simply exemplary embodiments of the inventive concepts defined in the appended claims. Hence, specific dimensions and other physical characteristics relating to the embodiments disclosed herein are not to be considered as limiting, unless the claims expressly state otherwise.

Figure 1:
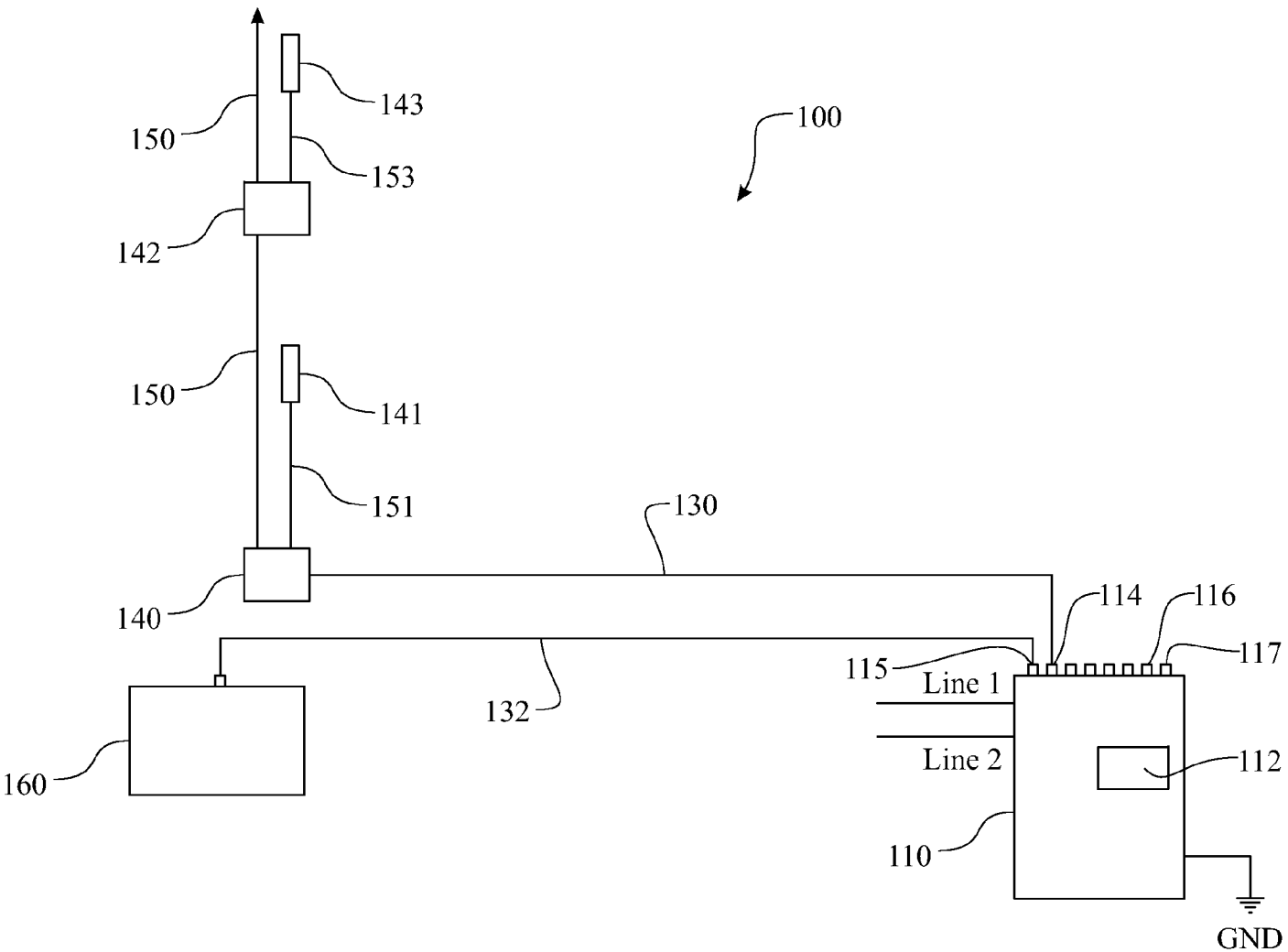
FIG. 1 is a plan view of a water leak detection system, in accordance with one embodiment of the present invention.

Referring now to the drawings wherein like elements are represented by like numerals throughout, there is shown in FIG. 1, a plan view of a water leak detection system, generally denoted at 100, according to the present invention. The water leak detection system 100 includes a central control unit 110 electrically coupled to a water alarm annunciator 160, via a data line 132, a plurality of address modules 140, 142, electrically coupled to the central control unit 110, via data lines 130, 150, and a plurality of water or moisture sensors 141, 143, electrically connected to each corresponding address module 140, 142, respectively. Although, as is illustrated in FIG. 1, one embodiment of the present invention depicts two address modules 140, 142 and two sensors 141, 143, respectively, it is understood that various embodiments of the present invention may include any number of sensors electrically coupled to any number of address modules. Thus, the number of address modules 140, 142 and sensors 141, 143 implemented will depend on the number of locations or appliances an individual wishes to monitor.

The system may be enhanced with the inclusion of additional facility sensors, including water level sensors within containers, door sensors, valves (such as opened, closed, etc.), and the like.

The integrity of the system may be monitored in parallel to ensure against a failure within the system itself. The system can monitor the signal interconnectivity to ensure signal integrity is maintained. This ensures the system functions continuously and uninterrupted.

In the preferred embodiment of the present invention, the monitoring sensors 141, 143 include water sensors. The water sensors 141, 143 may comprise any well-known water sensors on the market today. The sensors can include wire, metal or foil grids, electrical probes, semiconductor devices or components, plates, or any other suitable elements that are incorporated to detect or sense the slightest presence of water. In yet another embodiment, sensors 141, 143 may include moisture sensors to detect the presence of moisture and condensation, as both can be indicative of water leaks. A variety of additional sensors may be incorporated to measure and detect other conditions such as humidity, smoke, gases, pressure, and temperature. Thus, the water leak detection system 100 of the present invention may be designed to include water sensors, moisture sensors, humidity sensors, temperature sensors, smoke sensors, gas sensors, pressure sensors, or heat sensors. Different sensors can be used for different applications. For example, water sensors may be used with moisture sensors, or water sensors can be used with temperature sensors. As illustrated in FIG. 1, each sensor 141, 143 is electrically connected to a corresponding address module 140, 142, respectively, via cables or data lines 151 and 153. Preferably, the cables or data lines 151, 153 are insulated to prevent damage to the wires, and electrically shielded to reduce or prevent any electrical interference. Further, sensors 141, 143, may be hard-wired to each address module 140, 142, or alternatively sensors 141, 143 may detachably plug into each corresponding address module 140, 142 making it easy and convenient to replace or repair a sensor, if needed.

One or more address modules 140, 142 are electrically interfaced for communication between a plurality of water or moisture sensors 141, 143, and central control unit 110, and the address modules 140, 142 are electrically connected to the central control unit 110, via, data lines 130, 150. Data lines 19, 130, 153 and 150 may include Ethernet, universal serial bus, wireless such as Wi-Fi or Bluetooth, cables, or serial or parallel data lines. Signal transmission can be provided by electrical communication or the address modules 140, 142 may be housed in a junction box that is easily accessible. Alternatively, each module 140, 142 may be installed in separate locations throughout various areas within a residence or commercial building. The advantage of storing a plurality of address modules 140, 142 in a single junction box or enclosure is that it provides full access to all modules 140, 142 thereby facilitating any repair or replacement of modules, if needed. Each address module 140, 142 may comprise a plug-in type module making it easy to replace or repair a faulty module.

In one non-limiting embodiment of the present invention, multiple address modules 140, 142 are implemented and each module 140, 142 assigns a unique address or identifier to each individual sensor 141, 143, respectively. Each address module 140, 142 is preconfigured to have a different address or alternatively, each module 140, 142 may be programmed in-situ by an operator via the central control unit 110. Address modules 140, 142 electrically communicate with the central control unit 110, via bidirectional communication data lines 130 and 150. The central control unit 110 receives the signals generated by the sensors 141, 143, processes and correlates the sensors identifier and sensors detected conditions, and forwards the information to a central control panel 110 to provide point identification data of each sensor 141, and 143. In one embodiment, the point identification data includes the location of sensors 141, 143, and the detected condition of the sensor, as is better illustrated with reference to FIG. 2, below. The point identification data may also include any of the type of sensors 141, 143 used, calibration data of each sensor 141, 143, date and time sensors 141, 143 were activated, date each sensor 141, 143 was placed into service or replaced, diagnostic data of each sensor 141, 143, and any other information deemed necessary or desirable about each sensor 141, and 143.

It will be appreciated that to facilitate installation, each address module 140 and each sensor 141, 143 may be integrated into one sensor package to provide a compact, single or dual, addressable sensor including integral communication and an addressable point of identification. The use of an integrated addressable sensor reduces the amount of cabling that is needed to electrically connect a plurality of sensors to individual address modules, reduces costs, and saves installation time.

With continued reference to FIG. 1, the central control unit 110, which could be referred to as a water alarm control panel, houses the necessary central controller or microprocessing unit, read access memory (RAM), read only memory (ROM), and/or programmable ROM, needed to process any and all data and information. A set or series of machine-executable instructions or programs may be stored on one or more machine readable mediums, such as CD-ROMs or other type of optical disks, floppy diskettes, ROMs, RAM's, EPROM's, EPROM's, magnetic or optical cards, flash memory, or other types of machine-readable mediums suitable for storing programs, software, or electronic instructions. Alternatively, the methods may be performed by a combination of hardware and software. The functional components are housed within a durable, grounded, metal enclosure that is preferably installed in a dry, accessible area of a residential or commercial building. For example, the central control unit 110 can be installed in a building's electrical room, which is usually well ventilated, and includes a temperature-controlled atmosphere. The enclosure may or may not be waterproof and may include a lockable hinged front cover to prevent unauthorized personnel from entering central control unit 110. The central control unit 110 is generally powered by a suitable AC power supply using 110 or 1410 VAC. Advantageously; the central control unit 110 may include a battery backup power source, such as an uninterrupted power supply (commonly referred to as a UPS), a battery, a generator, and the like, to power the central control unit 110 in the event of a power failure. The backup power supply offers the advantage of continued water leak detection upon power failure. The system can be enhanced by incorporating features similarly found within a fire alarm control panel.

The central control unit 110 includes a plurality of data input ports 114, 116, and may also include a number of output ports 115, 117 to control a number of external devices such as relays, valves, fans or the like. The central control unit 110 also includes a control indicator panel 112 having a display for displaying system data, and input interface for programming or operating the central control unit 110. The display may include a number of status indicators that visually show the operative and functional status of the water leak detection system 100. Status indicators may include a plurality of differently colored light emitting diodes, or an LCD display showing phrases, words, characters, symbols, or animations. In some non-limiting examples, the display shows the status of supply voltage to the central control unit 110, status of the backup power source, operative function of address modules 140, 142 and sensors 141, 143, internal temperature of the panel 110, operative function of a central monitoring station 110, location data of each sensor 141, 143, diagnostic results, software versions in use, operative status of phone lines, and faulty conditions of devices, just to name a few.

With continued reference to FIG. 1, the central control unit 110 further includes an input interface or user interface (UI) for programming the central control unit 110. Programming may include inputting data, installing software, running diagnostics, browsing system parameters, providing operating instructions, programming address modules, programming sensors, testing, setting volume of alarms, setting parameters of sensors, etc. The input interface may include input keys, a keyboard, touchpad, a graphical user interface, or any other suitable inputting device. The input interface may include any number of number keys, symbol keys, letter keys, up and down arrows, right or left arrows, or any combination thereof.

The central control unit 110 of the present invention further includes telephone line ports that enable monitored system conditions to be remotely communicated over telephone lines L1 and L2. The phone lines L1, L2, may lead to a central, accessible area where appropriate personnel, workers or homeowners can receive voice or text messages of detected conditions. A speed dial device may be implemented within the central control unit 110 to call preprogrammed numbers to contact appropriate personnel should a water leak be detected. For example, a speed dial device may be used to call a phone, pager, or communicate over a network. One example of a speed dial device includes an auto dialer. Some well-known auto dialers on the market today allow the storage of multiple phone numbers and also provide voice or text messaging storage capabilities for generating text or voice messages. Thus, upon detecting a water leak, the central control unit 110 may activate a speed dialer to contact the appropriate personnel, supervisor, head plumber, or owner using a variety of communication devices such as computers, laptops, pagers, PDA's, telephones, or cellular phones. System or detection conditions may be communicated using a variety of communication system networks including a local area network (LAN), a wide area network (WAN), the Internet, a telephone line, a cable line, a radio channel, an optical communications line, and a satellite communications link. A variety of communications protocols may be part of the system. Methods of relaying a message may include text messaging, voicemail, prerecorded messages, email, instant messaging, or SMS messaging.

The central control unit 110 includes all the necessary software, programs, databases, and files required for efficiently monitoring water and moisture leaks throughout residential or commercial buildings. The central control unit 110 communicates with address modules 140, 142 and processes and produces the identification data of each sensor 141, and 143. The central control unit 110 also includes visual and audible alarms to alert an operator or supervisor of possible water leaks when the sensors 141, 143 detect the presence of water or moisture. The visual and audible alarms may be incorporated in both the central control unit 110 and the remote water alarm annunciator 160. Audible alarms may be programmed to include a delay, operate for a predetermined amount of time, and can be selectively turned on or off at either the central control unit 110 or the water alarm annunciator 160.

Figure 2:
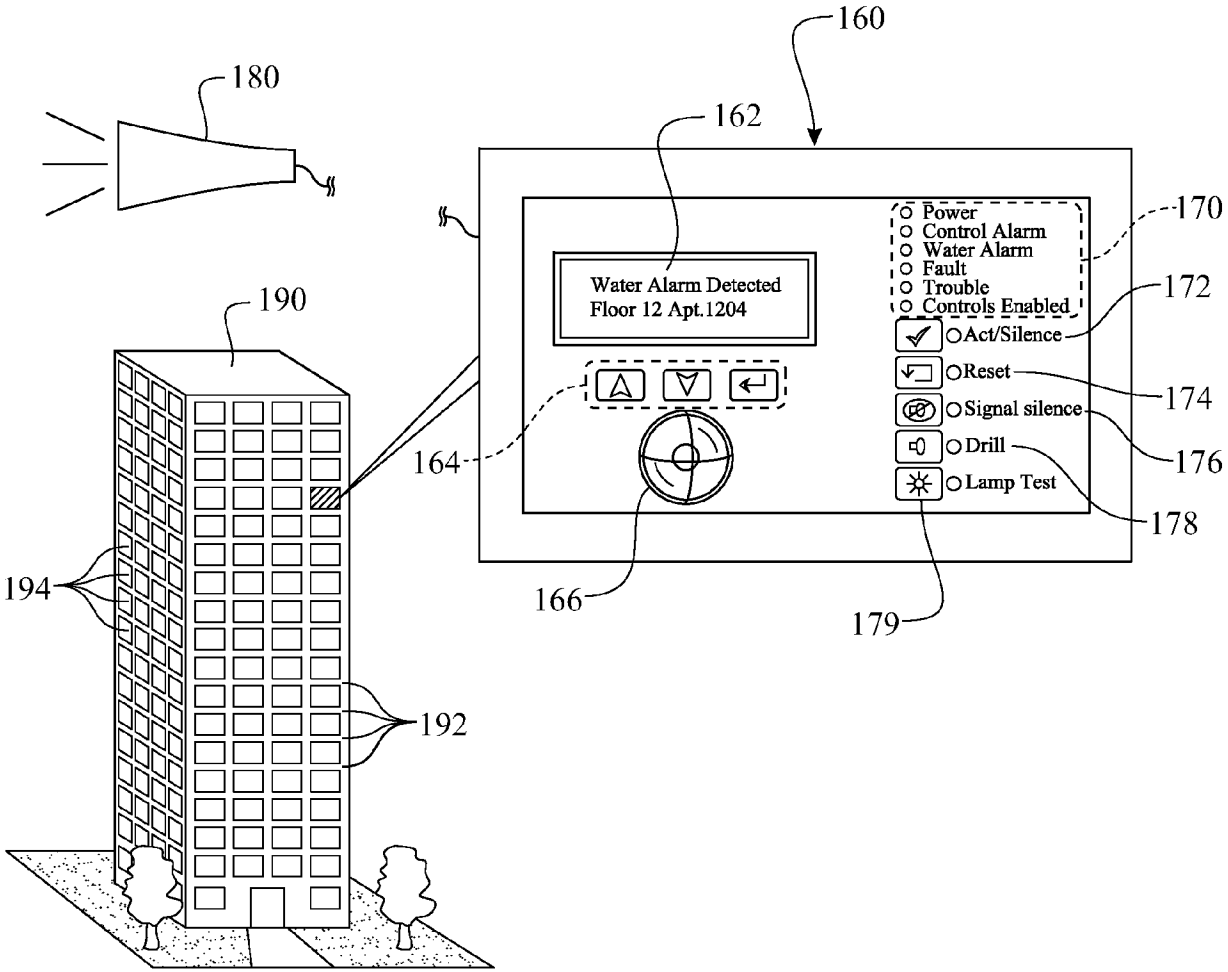
FIG. 2 is an isometric view of a central monitoring station comprising an annunciator, in accordance with the present invention.

Turning now to FIG. 2, there is shown an isometric view of a central monitoring station, represented as the water alarm annunciator 160. The water alarm annunciator 160 is electrically coupled to a central control unit 110, via a data line 132, as better illustrated in FIG. 1. The water alarm annunciator 160 electrically communicates with the central control unit 110 by any one of Ethernet, universal serial bus, wireless such as Wi-Fi or Bluetooth, cables, or serial or parallel data lines. In the preferred embodiment, the water alarm annunciator 160 is remotely located at a central monitoring station, supervisor's station, a guard's desk, or remote office where an individual can easily view monitored conditions.

The water alarm annunciator 160 of the present invention includes a status indicator section 170 for showing the operative status and function of water detecting sensors and system parameters. In one non-limiting example, the status indicator section 170 includes a plurality of light emitting diodes, LED's. Individual light emitting diodes each provide a visual indication of a system condition or parameter. In one non-limiting example, individual LED's provide visual indications of operative power, a control alarm, a water alarm, a fault in the system, trouble, and whether certain controls are enabled. Similarly, an audible alert 166 can be integrated into the water alarm annunciator 160 to provide an audible indication of an alert condition. An exemplary integrated audible alert 166 can be a speaker. The water alarm annunciator 160 further includes selection or input keys for remotely programming the water leak detection system 100. In one example, the water alarm annunciator 160 includes an acknowledge or silence key 172 for allowing a remote viewer to acknowledge or silence an alarming monitored condition, a reset key 174 for resetting a particular feature, a signal silence key 176 to silence an audible alarm, a drill key 178 to test system operations, and a lamp test key 179 for testing the operative function of status indicators. The water alarm annunciator 160 further includes programmable keys or selection keys 164 that are used for scrolling, selecting, and viewing system point identification data.

A remotely located and operated audible alert 180 can be integrated into the system. An exemplary remotely located and operated audible alert 180 can be a horn, a siren, and the like. The remotely located and operated audible alert 180 is preferably located in an open area, and external to the structure. Alternatively, the remotely located and operated audible alert 180 can be affixed in a location within an interior of the structure providing an audible path wherein the alarm can be heard on an exterior of the building.

The water alarm annunciator 160 can include relays and/or other associated controls to remotely operate valves, such as either opening or closing a target valve when desired or deemed necessary. The relays and/or other associated controls may be included within the water alarm annunciator 160, the control panel 110, or any other object that would be integrated into the system. For example, the water leak detection system 100 might detect a leak on a specific floor of a structure. The water leak detection system 100 would then identify any potential water source and associated valve(s) contributing to the leak. The water leak detection system 100 subsequently would turn all off the associated valves off.

The water alarm annunciator 160 includes a liquid crystal display 162 (LCD), for displaying water leak point identification data, as illustrated in FIG. 2. As demonstrated in FIG. 2, a sensor 141, 143 has detected the presence of water and has relayed the informative signal to the central control unit 110. The central control unit 110 processes the received signal and forwards point identification data to the water alarm annunciator 160, via, data lines 132, where the point identification data is visually displayed on LCD 162. Thus, as shown, a water leak has been detected in apartment "1204" of a large apartment building 190, resulting in a water alarm detected warning. The central management of a control panel 110 and a remote water alarm annunciator 160 provides an efficient water leak detection system for optimum use in large residential buildings. A plurality of sensors may be incorporated throughout various areas in a number of different apartments 194 for monitoring and detecting the presence of water or moisture. In one embodiment, each apartment 194 would have at least one sensor 141, 143 deployed therein in a manner to monitor for any water leaks. In another embodiment, each floor level 192 of the large apartment building 190 would have at least one sensor 141, 143 deployed thereon in a manner to monitor for any water leaks. Information relating to a detected condition is centrally processed and sent to a remote observer. Although the disclosure describes a water leak detection system 100 deployed in a large apartment building 190, it is understood that the water leak detection system 100 can be deployed in any single or multistory building. The apartments 194 would be synonymous with or representative of any subdivided section of the building structure 190.

Figure 3:
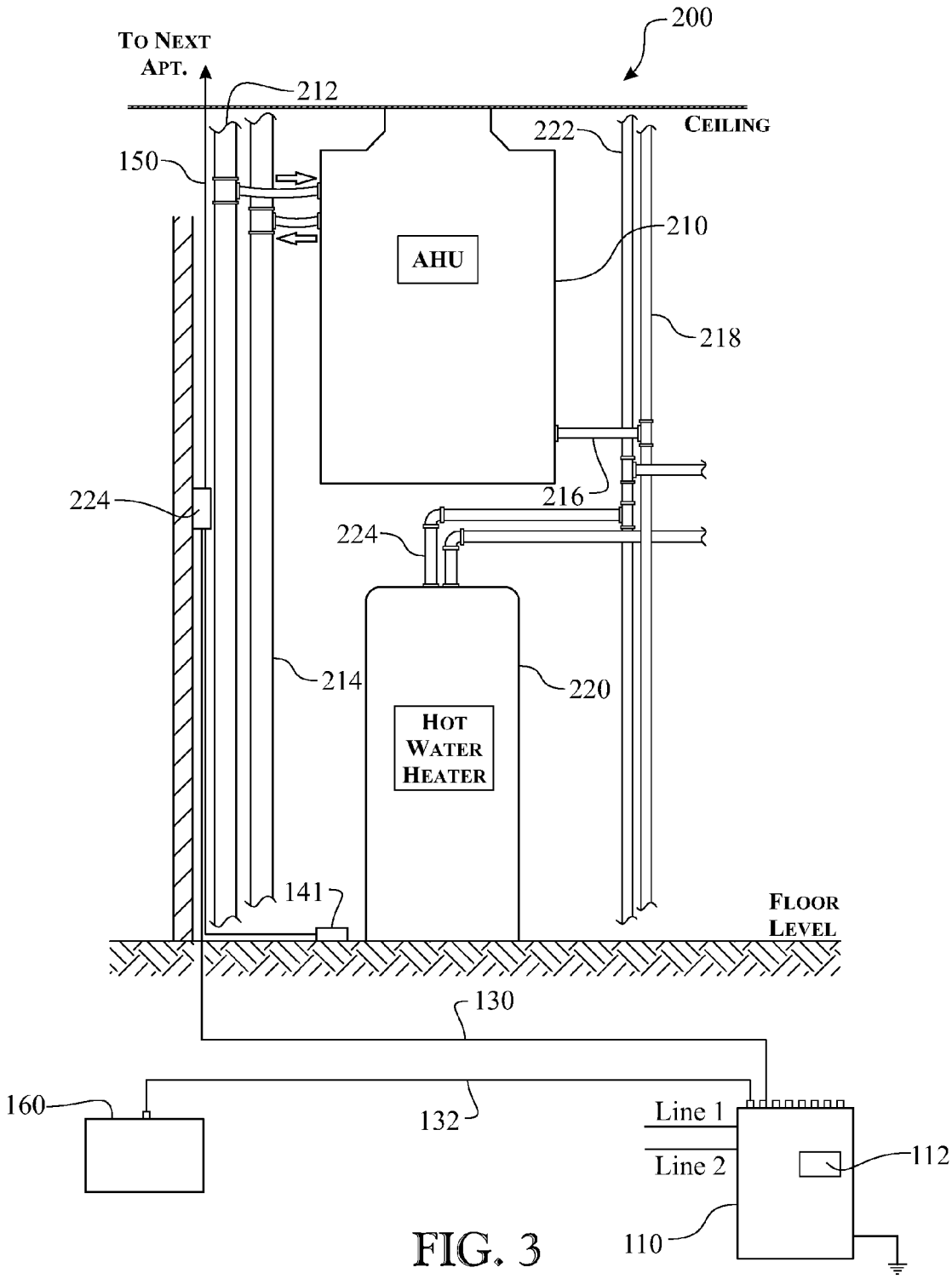
FIG. 3 is a plan view of an exemplary installation of the water leak detection system, in accordance with one embodiment of the present invention.

Turning now to FIG. 3, there is shown a plan view of an exemplary installation of the water leak detection system 100, in accordance with the present invention. The water leak detection system 100 of the present invention, may be implemented in a variety of locations where detecting the presence of water or moisture is desired. Thus, one or more sensors 141, 143 are placed in locations where water leaks are likely to occur such as near a sink or toilette, at a pump, under or near household appliances, near drains, along windows, in walls or attics, in basements, along supply or drain pipes, at particular joint connections, under or near an air conditioner, in collection trays, near appliances, near air conditioners, under or near a water heater tank or any possible water generating source that may lead to a water leak.

Typically, residential housing units, condos, townhouses or apartments include an air conditioning closet 200 for housing an air conditioning and heating unit (AHU) 210, and hot water heater tank 220. Operatively coupled to the AHU 210 and water tank 220 is an arrangement of supply or inlet water pipes 222, 67, 224, and draining or outlet water pipes 218, 214, 216 and 219. Pipe joints and connections, moisture or condensation generated by air conditioners, AHU 210, and hot water tanks, are all possible sources of water leaks. Collection trays (not shown) are often placed underneath air conditioners or hot water tanks to collect any water, or condensation generated from such appliances.

With continued reference to FIG. 3, in one non-limiting exemplary embodiment, one or more water leak detection sensors 141 are placed within an air conditioning and heating closet 200. Sensor 141 is positioned at a lower elevation, generally on the floor level of an air conditioning and heating closet 200. An address module 140 is safely enclosed in a junction box, and the module 140 is electrically interfaced between sensor 141 and the central control unit 110, via data lines 130. As described earlier, address module 140 is used to assign an identifier or address to each water or moisture sensor 141. The central control unit 110 is centrally located in a convenient, accessible area within the residential or commercial building. Multiple data lines leading from a plurality of water and/or moisture sensors are collectively centralized in one location and operatively connected to the central control unit 110. The central control unit 110 is also connected to a telephone or to a speed dial device, via, telephone line 1 and line 2 to alert a supervisor, plumber, repair service, or management of one or more water leaks. The water alarm annunciator 160 is installed at a remote, central monitoring location and is electrically connected to the central control panel 110, via, the data lines 132, to permit an observer to remotely monitor for any water leak conditions, within a plurality of air conditioning closets 200, from a central dedicated area. The data line 150 extends from the junction box address module 140 and leads to a second address module (not shown) and corresponding sensor, which are operatively positioned within an adjacent air conditioning closet at a second monitoring location. Alternatively, a plurality of address modules may be enclosed in a single junction box where cables lead from each individual address module to each water or moisture sensor located within a number of closets.

Upon detection of water, sensor 141 transmits a signal to the central control unit 110. The central control unit 110 processes the signal, performs various functions associated with sensor 141, and transmits point identification data to the water alarm annunciator 160, via data lines 132, to provide a visual and audible identification of a detected water leak. Point identification data includes the detected location of the leak that is associated with the water sensor identifier, and the detected condition status, such as water alarm detected. After a predetermined time period, the central control unit 110 sends a messaging signal via, telephone lines 1 and 2 to a pager, telephone, auto dialer, PDA, cellular phone, or network to notify appropriate personnel of a water leak. Upon proper inspection and repair, the water detection system is reset.

The central control unit 110 may generate output signals upon receiving a detected signal from a water sensor 141. For example, the central control unit 110 may provide output signals to output ports 115, 117 to control external devices, such as one or more shutoff valves to immediately stop the supply of water thus mitigating water damage. Other external devices may include pumps, fans, lights, or any other device a user wishes to operate upon detection of a water leak.

The water leak detection system 100 of the present invention provides a centralized water detection and monitoring system including, a plurality of water or moisture sensors 141, 143 situated in residential or commercial buildings for detecting water leaks, a central control unit 110, and a water alarm annunciator 160. The water alarm annunciator 160 is conveniently installed at a remote monitoring station permit an observer to monitor point identification data of each water or moisture sensor 141 and 143.

It is understood that the water leak detection system 100 can be expanded to monitor for additional concerns with the inclusion of one or more of the following sensing devices:

a. a water sensor,
b. a floatation sensor,
c. a moisture sensor,
d. a humidity sensor,
e. a temperature sensor,
f. a gas sensor,
g. a pressure sensor,
h. an air duct sensor,
i. a thermal sensor,
j. a fire sensor,
k. a heat sensor, and
l. a smoke sensor, and
m. the like.

It is understood that the water leak detection system 100 can be expanded to monitor for additional concerns one or more of the following structure support systems:

a. a fire sprinkler system,
b. a hot water heating system,
c. an HVAC system,
d. an HVAC chiller system,
e. a computer room,
f. a freezer,
g. a fluid containment system, and
h. the like.

As variations, combinations and modifications may be made in the construction and methods herein described and illustrated without departing from the scope of the invention, it is intended that all matter contained in the foregoing description or shown in the accompanying drawings shall be interpreted as illustrative rather than limiting. Thus, the breadth and scope of the present invention should not be limited by any of the above-described exemplary embodiments, but defined in accordance with the foregoing claims appended hereto and their equivalents.

What is claimed is:

1. A water leak detection system deployed within a multistory building, the water leak detection system comprising:

a central control unit;

a plurality of address modules provided in electrical communication with said central control unit, wherein said electrical communication is provided through a central control data line spanning therebetween;

a plurality of sensors, each of said plurality of sensors provided in electrical communication with a respective address module of said plurality of address modules, wherein said electrical communication is provided through an address module data line spanning therebetween, wherein each of said plurality of address modules associates an identifier with each respective sensor; and a multistory building comprising a plurality of floors, wherein at least one sensor is deployed on each of said plurality of floors;

a water alarm annunciator provided in signal communication with said central control unit, said water alarm annunciator displaying point identification data of each of said plurality of sensors;

wherein said central control unit stored machine-executable instructions to perform the operations of:

detecting a signal from an address module, said signal being responsive to a positive detection from the respective sensor;

waiting for a predetermined time period to pass;

sending a signal to a remote device to notify said positive detection by said sensor;

identifying at least one remote valve associated to said sensor; and sending an operation signal to said at least one remote valve to revert said positive detection by said sensor.

2. The water leak detection system of claim 1, the building comprising a plurality of apartments, wherein at least one sensor is deployed on each of said plurality of apartments.

3. The water leak detection system of claim 1, wherein said plurality of sensors includes at least one of a water sensor, a floatation sensor, a moisture sensor, a humidity sensor, a temperature sensor, a gas sensor, a pressure sensor, an air duct sensor, a fire sensor, a heat sensor, and a smoke sensor.

4. The water leak detection system of claim 1, wherein said plurality of sensors includes at least one of a water sensor, a floatation sensor, a moisture sensor, and a humidity sensor.

5. The water leak detection system of claim 4, wherein said point identification data includes location data of each sensor and a monitored condition associated with each sensor.

6. The water leak detection system of claim 1, wherein said plurality of sensors includes at least one floatation sensor.

7. The water leak detection system of claim 1, wherein said point identification data includes location data of each sensor and a monitored condition associated with each sensor.

* * * * *